US006851602B2

(12) United States Patent
Gosis et al.

(10) Patent No.: US 6,851,602 B2
(45) Date of Patent: Feb. 8, 2005

(54) STRAIGHT-EDGED PACKAGING CONTAINER AND DEVICE FOR FORMING SAME

(75) Inventors: Anatoly Gosis, Palatine, IL (US); Michael D. Loeschen, Hawthorn Woods, IL (US); Ian Brooks, Lake Barrington, IL (US); Lee A. Sheridan, Barrington, IL (US); G. Michael Velan, Mt. Propspect, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/264,854

(22) Filed: Oct. 4, 2002

(65) Prior Publication Data

US 2004/0065724 A1 Apr. 8, 2004

(51) Int. Cl.[7] ..... B65D 43/08
(52) U.S. Cl. ..... 229/125.22; 229/125.19
(58) Field of Search ..... 229/125.22, 120.29, 229/120.38, 164, 103.2; 220/4.01

(56) References Cited

U.S. PATENT DOCUMENTS

| | | | | |
|---|---|---|---|---|
| 1,069,021 A | | 7/1913 | Miller | |
| 1,758,230 A | | 5/1930 | Lange | |
| 1,871,888 A | | 8/1932 | Johnson | |
| 2,194,669 A | | 3/1940 | Mumford | |
| 2,317,884 A | | 4/1943 | Clouston | |
| 2,731,167 A | | 1/1956 | Moore | |
| 3,543,994 A | | 12/1970 | Clark | |
| 3,552,633 A | * | 1/1971 | Ketler | 229/238 |
| 3,669,338 A | | 6/1972 | Cornell et al. | |
| 3,833,116 A | * | 9/1974 | Howe | 206/431 |
| 4,607,750 A | | 8/1986 | Valenti | |
| 4,629,069 A | | 12/1986 | Pugh | |
| 4,662,512 A | | 5/1987 | Durand | |
| 4,871,067 A | * | 10/1989 | Valenti | 229/164 X |
| 4,976,374 A | | 12/1990 | Macaluso | |
| 5,141,149 A | * | 8/1992 | Fulton | 229/103 |
| 5,657,872 A | * | 8/1997 | Leftwich et al. | 229/122 X |
| 6,027,017 A | * | 2/2000 | Kuhn et al. | 229/164 X |
| 6,382,447 B1 | | 5/2002 | Loeschen | |
| 6,499,655 B1 | * | 12/2002 | Moen | 229/120.24 |

* cited by examiner

*Primary Examiner*—Tri M. Mai
(74) *Attorney, Agent, or Firm*—Mark W. Croll, Esq.; Donald J. Breh, Esq.; Welsh & Katz, Ltd.

(57) ABSTRACT

A packaging container is formed from preformed, rigid base and cover units of U-shaped cross-section having a generally flat bottom wall. The base unit is configured so that its side walls fit within and are embraced by side walls of the cover unit when assembled as a container. The base unit forms an end closure from first and second closure panels extending from an end of the base unit. The closure panels are separated from the base unit and each other by first and second fold lines. The base unit side walls have straight-cut corners at a juncture with the first closure panel, and the first closure panel side walls have straight-cut corners adjacent to the base unit, forming a square corner when folded. The first closure panel side walls also have straight-cut corners adjacent to the second closure panel, and the second closure panel side walls have straight-cut corners adjacent to the first closure panel, forming a square corner when folded to form the end closure. A device for cutting and embossing the packaging container is also disclosed.

11 Claims, 9 Drawing Sheets

STRAIGHT-EDGED PACKAGING CONTAINER AND DEVICE FOR FORMING SAME

BACKGROUND OF THE INVENTION

The present invention is directed to a packaging container. More particularly, the present invention pertains to a packaging container having self-formed, non-mitered end closures. A device for forming cuts and embossings in the container is also disclosed.

Packaging for lengthy items takes many forms. One construction includes a pair of corrugated, laminated paperboard top and bottom U-shaped channels configured for one to fit within the other. Most packages formed in this manner require separate end closures or caps, usually manufactured from cardboard or wood. These caps generally are stapled to adjacent package walls. Not only does this method necessitate close-fit manufacturing, but it is also very cumbersome at installation, and may cause content damage due to incompletely formed or off-positioned staples.

In another variety of packaging container, one of the top and bottom U-shaped channels has a notch cut into opposing side walls of the "U," so that the "U" portion may be folded over at a 90 degree angle. In such a configuration, channel ends are closed by the folded base portion and the side walls of the "U," which are folded over adjacent side walls. To seal such a package, tape or a like strip-type adhesive sealant must be extended over the flaps that then are folded over the adjacent side walls. Even though a seal may be formed, however, openings may remain at the juncture of the folded-over base portion and the cover portion, seriously weakening the package. This design is disclosed in U.S. Pat. No. 4,976,374, which is incorporated herein by reference.

Another existing packaging container, disclosed in U.S. Pat. No. 6,382,447, resolves the above-referenced problems by providing a packaging container in which the entirety of the end closure is formed from the packaging material itself. However, the container base unit, which forms end closures for the packaging container, features mitered corners. These mitered corners require complex die-cutting with mirror-image tools, and mandatory strapping at specific positions to restrain the mitered flaps.

Accordingly, there exists a need for a packaging container cut without miters in which the entirety of the end closure is formed from the packaging material itself. Desirably, the container's end closures are readily sealable using commonly available materials, and provide a high degree of structural strength and package integrity. Such a configuration allows for no gaps at its closure locations. Most desirably, the container may be prepared with nothing more than two straight saw-cuts on each package end.

BRIEF SUMMARY OF THE INVENTION

A packaging container includes a preformed, rigid base unit of U-shaped cross-section having a generally flat bottom wall and opposing side walls, and a preformed, rigid cover unit of U-shaped cross-section having a top wall and opposing side walls. The cover unit is configured so that the side walls of the bottom unit are fitted within and embraced by the side walls of the cover unit when the base unit and cover unit are assembled as a container.

For purposes of the present disclosure, the packaging material, although referred to as having a U-shaped cross-section is, in fact, formed from a material having a channel-like or squared U-shape having a flat or near-flat bottom wall. The corners can be formed having a radius of curvature (e.g., rounded) or they may be formed having relatively sharp angles. However, again, for purposes of the present disclosure, the container material is referred to as "U-shaped".

The base unit forms an end closure for the packaging container. The end closure is formed from a first closure panel extending from and adjacent to an end of the base unit, and a second closure panel extending from and adjacent to an end of the first closure panel. The base unit and the first closure panel are separated from one another by a first fold line. The first closure panel and the second closure panel are separated from one another by a second fold line.

The base unit side walls have straight-cut corners at a juncture with the first closure panel, and the first closure panel side walls have first straight-cut corners adjacent to the base unit. The first closure panel side walls additionally have second straight-cut corners adjacent to the second closure panel, and the second closure panel side walls have straight-cut corners adjacent to the first closure panel.

The first closure panel is configured for folding generally perpendicular to the base unit bottom wall, and the second closure panel is configured for folding generally perpendicular to the first closure panel and generally parallel to the base unit bottom wall.

In a preferred embodiment, the base unit side walls are about equal in height to the first and second closure panel side walls. Preferably, the first and second closure panel side walls are configured for insertion inside the base unit side walls when the end closure is formed. Preferably, the base unit includes two end closures, each positioned at an end of the base unit.

Alternately, a third closure panel extends from and is adjacent to an end of the second closure panel. The second and third closure panels are separated from one another by a third fold line. The third closure panel is configured for folding generally parallel to the second closure panel and to the base unit bottom wall.

Alternately, a divider is placed in the base unit, segregating the base unit into a plurality of compartments. Preferably, the divider is attached to a side wall of the base unit.

In an additional embodiment, a packaging container includes a plurality of pre-formed, rigid base units of U-shaped cross-section having a generally flat bottom walls and opposing side walls, and a preformed, rigid cover unit of U-shaped cross-section having a generally flat top wall and opposing side walls. The cover unit is configured so that the side walls of the bottom units are fitted within and embraced by the side walls of the cover unit when the base unit and cover unit are assembled as a container.

The cover unit forms an end closure for the packaging container. The end closure is formed from a first closure panel extending from and adjacent to an end of the cover unit, and a second closure panel extending from and adjacent to an end of the first closure panel. The cover unit and the first closure panel are separated from one another by a first fold line. The first closure panel and the second closure panel are separated from one another by a second fold line.

The cover unit side walls have straight-cut corners at a juncture with the first closure panel, and the first closure panel side walls have first straight-cut corners adjacent to the cover unit. The first closure panel side walls additionally have second straight-cut corners adjacent to the second closure panel, and the second closure panel side walls have straight-cut corners adjacent to the first closure panel.

The first closure panel is configured for folding generally perpendicular to the cover unit top wall, and the second closure panel is configured for folding generally perpendicular to the first closure panel and generally parallel to the cover unit top wall.

In a preferred embodiment, the cover unit side walls are about equal in height to the first and second closure panel side walls. Preferably, the first and second closure panel side walls are configured for insertion inside the cover unit side walls when the end closure is formed. Preferably, the cover unit includes two end closures, each positioned at an end of the base unit. Preferably, the side walls of the plurality of base units are attached to each other.

A device forms cuts in upstanding side walls and an embossing in a base wall of a packaging container unit that has a generally U-shaped cross-section, in which the base wall is generally flat. The device includes a frame, an embossing/guide assembly having at least one embossing end-effector, the embossing end-effector configured for positioning in the packaging container between the upstanding side walls and against the base wall, and a cutting assembly having upstanding, opposing cutting blades configured to cut into the upstanding side walls of the packaging container unit.

The device includes first drive means generally connected to the embossing/guide assembly and second drive means generally connected to the cutting assembly. The first drive means is actuated to engage the embossing/guide assembly to enter the packaging container and engage the upstanding side walls of the container. The second drive means is actuated to bring the cutting blades into contact with and cut the upstanding side walls of the packaging container. The cutting blades moving toward the unattached e.g., free-) ends of the walls prevents collapse of the walls regardless of the thickness of the material during the cutting operation.

The embossing/guide assembly can include a guide to guide the cutting blades as they cut the packaging container upstanding side walls. The embossing/guide assembly can be configured for urging into the base wall of the packaging container to form a fold line therein.

In a current device, the first and second drive means are pneumatic cylinders. The first cylinder can be a two-step cylinder to, in a first step, position the end-effector within the package and, in a second step urge the end-effector into the base wall to form the embossing in the base wall.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
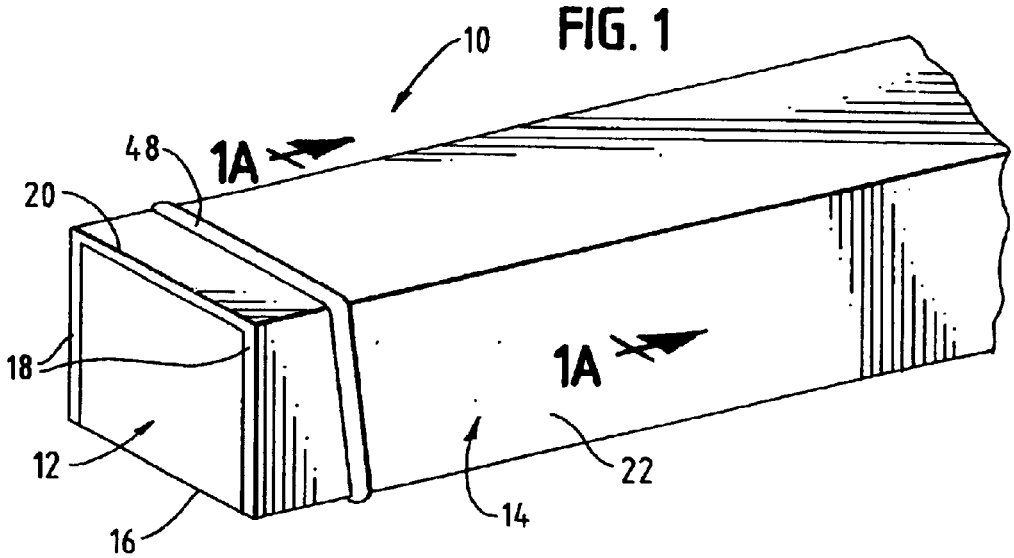
FIG. 1 is a partial perspective view of an embodiment of a packaging container with straight-cut end closures constructed in accordance with the principles of the present invention, the container being shown in a fully constructed or assembled form and further shown with a band securing the packaging container closed.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular FIG. 1, there is shown a packaging container 10 embodying the principles of the present invention. The packaging container 10 includes a base unit 12 and a cover unit 14. Both the base unit 12 and the cover unit 14 are formed in an U-shaped cross-section. Preferably, the base unit 12 and the cover unit 14 are formed from laminated paperboard material. The base unit 12 includes a generally flat bottom wall 16 and side walls 18. The cover unit 14 includes a top wall 20 and side walls 22. Again, those skilled in the art will appreciate that although the container is referred to as "U-shaped", the package is actually formed from a channel-like structure having a flat or near-flat bottom wall 16.

Figure 1A:
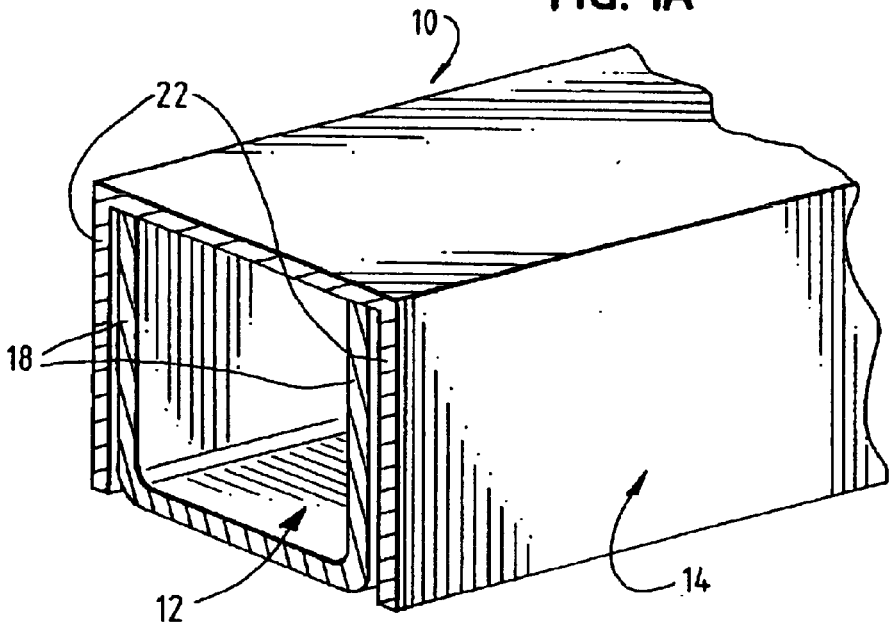
FIG. 1A is a cross-sectional view of the constructed container taken along line 1A—1A of FIG. 1

As seen in FIG. 1A, the base unit 12 and cover unit 14 are sized so that upon assembly into a container the side walls 18 of the base unit 12 fit within the side walls 22 of the cover unit 14. As will be recognized by those skilled in the art, the packaging container 10 can be flipped, in which case the side walls of the base will fit within the side walls of the cover.

Figure 2:
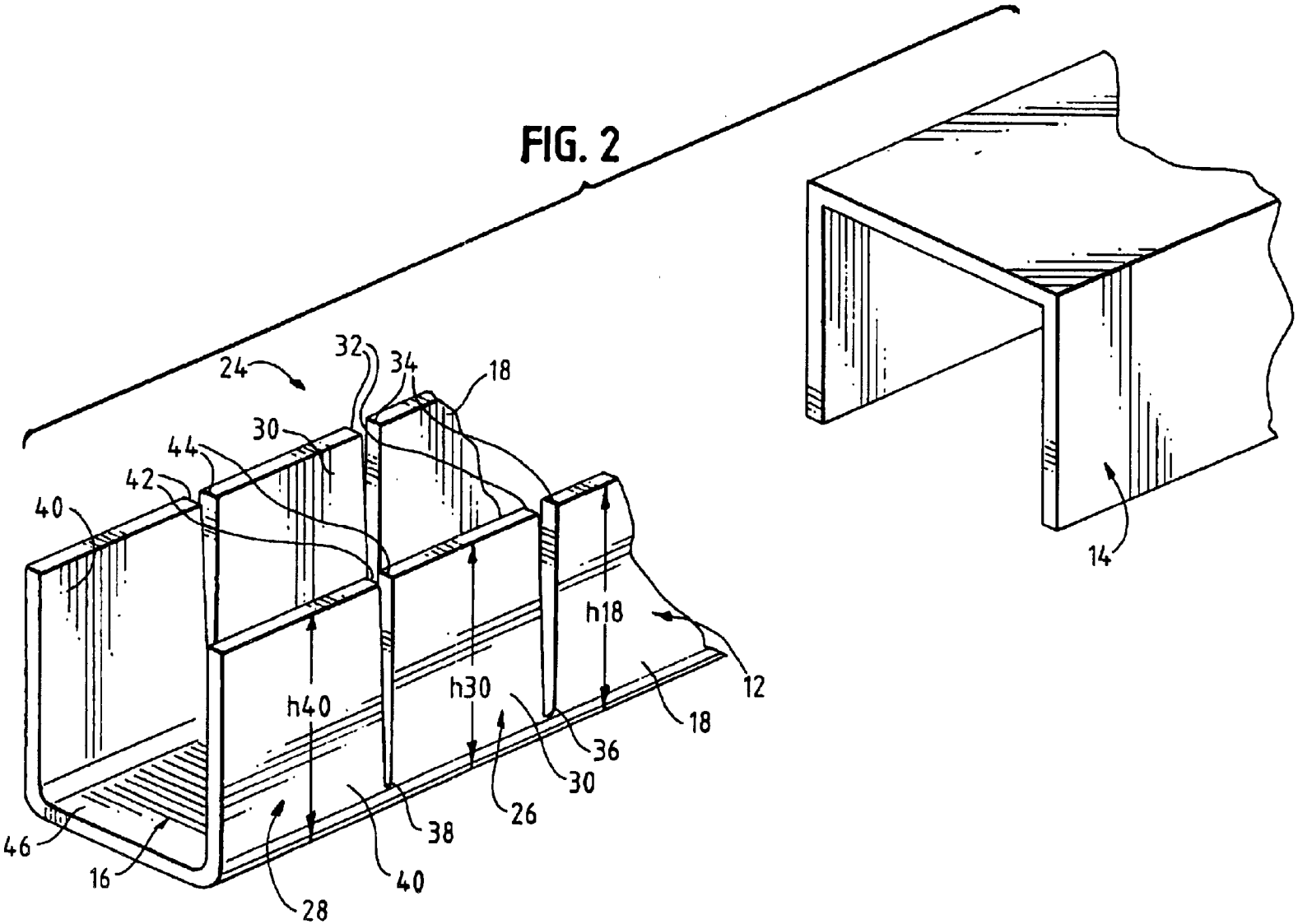
FIG. 2 is a partial perspective view of an embodiment of the base and cover units of the packaging container, with the first and second closure panels of the base unit laid open, prior to folding and securing.
Figure 3:
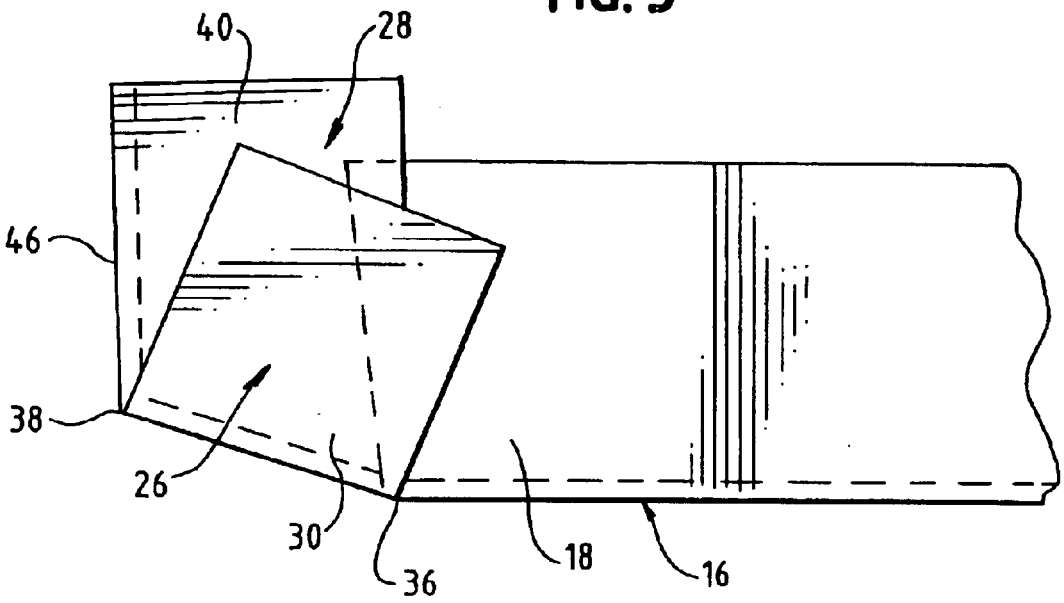
FIG. 3 illustrates the folding in-progress of the end closure of FIGS. 1 and 2.

The packaging container 10 includes a novel end closure 24 configuration, as shown in FIGS. 2 and 3. The closure 24 configuration includes first and second straight-cut closure panels 26, 28 formed from an extension of the base unit 12. For purposes of the present disclosure, the closure panels 26, 28 will be presented as part of the base unit 12. However, as will be recognized by those skilled in the art from an examination of the drawings, the closure panels 26, 28 can be formed as part of the cover unit 14 when the cover unit 14 has a wider cross-section than that of the base unit 12. Both of these configurations are within the scope and spirit of the present invention.

The first panel 26 is formed in the base unit 12 adjacent to the location in the base unit 12 corresponding to the end of the cover unit 14. The side walls 30 of the first panel 26 have first straight-cut corners 32. The base unit side walls 18 also have straight-cut corners 34, immediately adjacent to the first panel straight-cut corners 32. A first fold line or crease 36 can be formed in the base unit bottom wall 16 at the juncture of the straight-cut corners 32, 34 and the bottom wall 16 to facilitate folding.

The base unit 12 second closure panel 28 is adjacent to the first closure panel 26. The second closure panel 28 is separated from the first panel 26 by a second fold or crease line 38 formed in the bottom wall 16, parallel to the first fold line 36. The side walls 40 of the second closure panel 28 include straight-cut corners 42 at the juncture with the first closure panel 26. The side walls 30 of the first closure panel 26 include second straight-cut corners 44 adjacent to the second closure panel 28. The height $h_{18}$ of the base unit side walls 18 is about equal to the heights $h_{30}$, $h_{40}$ of the first closure panel side walls 30 and the second closure panel side walls 40.

Figure 4:
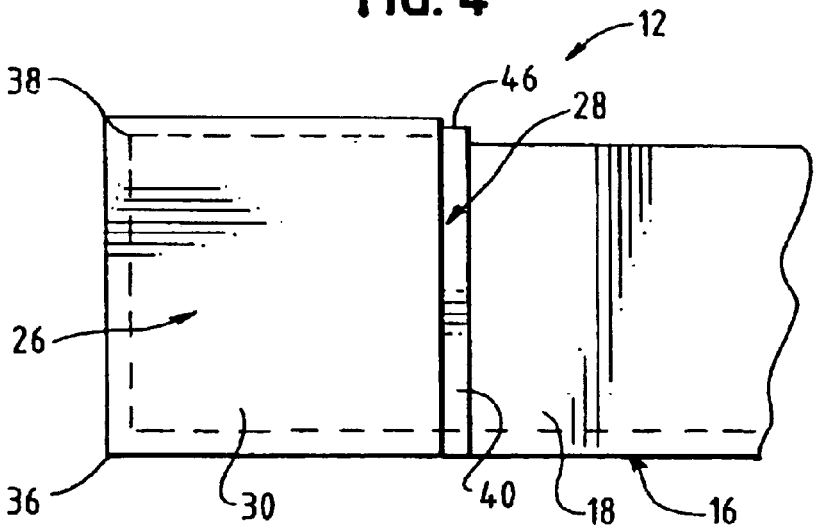
FIG. 4 further illustrates the folding of the end closure of FIGS. 1–3.

Referring to FIGS. 2–4, assembling the package 10 is straightforward and readily carried out. The base unit 12 is placed on a surface, with the first and second closure panels 26, 28 laid out flat. The articles to be packaged are placed in the base unit 12. The first panel 26 is then folded upwardly, so that the first panel 26 is perpendicular to the bottom wall 16 of the base unit 12. As the first panel 26 is folded, its side walls 30 can be inserted between the base unit side walls 18. The second panel 28 is then folded over, perpendicular to the first panel 26, so that the bottom wall 46 of the second panel 28 lies parallel to the bottom wall 16 of the base unit 12. As the second panel 28 is folded, its side walls 40 can be inserted between the side walls 30 of the first panel 26. The cover unit 14 is then placed over the assembled base unit 12, its ends aligned with the base unit first fold line 36, providing an essentially self-contained package 10.

In addition, because the package 10 can be sealed using a non-adhesive element (such as an exemplary band or wire-tie 48), it is readily reusable. Known packages that require sealing with an adhesive such as tape will typically lose one or more layers of paperboard laminate when removing the adhesive. The present package 10 can be sealed without an adhesive, i.e., with a band, greatly increasing the reusability of the package 10. Alternately, of course, an adhesive can be used if it is so desired.

Figure 5:
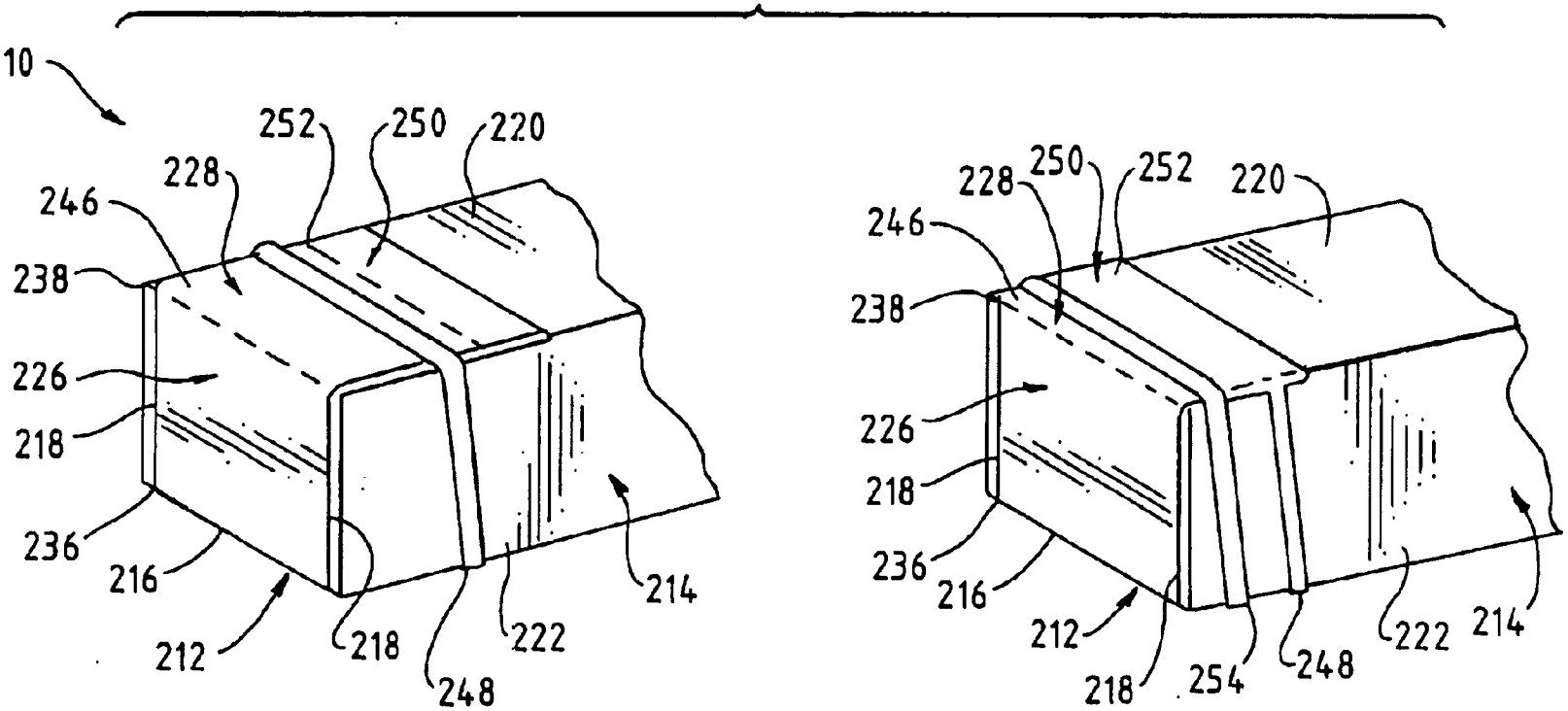
FIG. 5 is a partial perspective view of an alternate embodiment of a packaging container with straight-cut end closures constructed in accordance with the principles of the present invention, the container being shown in a fully constructed or assembled form and further shown with two bands securing the packing container closed.

In an alternate embodiment 210, as shown in FIG. 5, a third closure panel 250 can extend from the second panel 228. The third closure panel 250 can be adjacent to the second closure panel 228. The third closure panel 250 can be separated from the second panel 228 by a third fold or crease line 252 formed in the bottom wall 216, parallel to the first and second fold lines 236, 238. Unlike the first closure panel 226, in this embodiment 210 the second and third closure panels 228, 250 would have no side walls.

To assemble the package 210, the base unit 212 can be placed on a surface, with the first, second and third closure panels 226, 228, 50 laid out flat. The articles to be packaged can be placed in the base unit 212. The cover unit 214 then can be placed over the articles with the cover unit side walls 222 outside of and abutting the base unit side walls 218. The ends of the cover 214 can be aligned with the base unit first fold line 236. The first panel 226 can be folded upwardly, so that the first panel 226 would be perpendicular to the generally flat bottom wall 216 of the base unit 212. As the first panel 226 is folded, its side walls (not shown) can be inserted between the base unit side walls 218. The second panel 228 then can be folded over, perpendicular to the first panel 226, so that the bottom wall 246 of the second panel 228 can lie parallel to the bottom wall 216 of the base unit 212, and on top of the generally flat top wall 220 of the cover unit 214.

A non-adhesive element (such as the exemplary band or wire-tie 248) then can be used to seal the package 210. Alternately, of course, an adhesive can be used if it is desired. To provide extra closure strength, the third panel 250 then can be folded over, parallel to the second panel 228 and the bottom wall 216 of the base unit 212. A second non-adhesive element (such as a second exemplary band or wire-tie 254) then can be used to provide an additional seal for the package 210.

Figure 6:
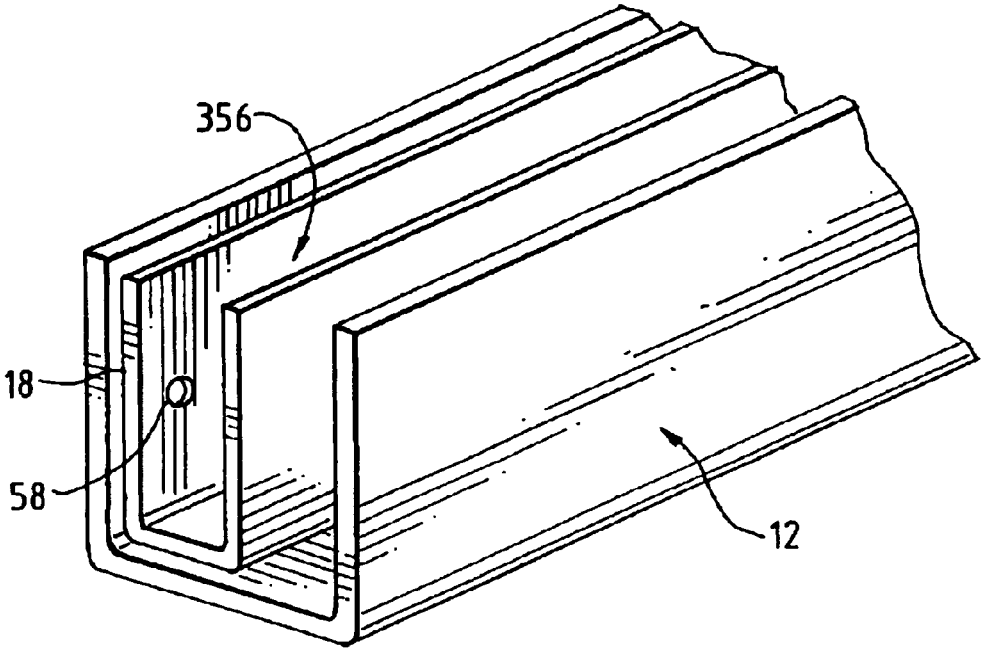
FIG. 6 is a partial perspective view of an alternate embodiment of the base unit of the packaging container, illustrating divider positioning.

As seen in FIG. 6, a divider 356 can be placed in the base unit 12, segregating the base unit 12 into a plurality of compartments and allowing for separation of articles to be packaged. In a current embodiment, the divider 356 can be formed in a U-shaped cross-section. Preferably, the divider 356 is made of laminated paperboard material. The divider 356 can be attached to the side wall 18 of the base unit 12 through a variety of means. In a current embodiment, the divider 356 is attached to the base unit side wall 18 with plastic rivets 58.

Figure 7:
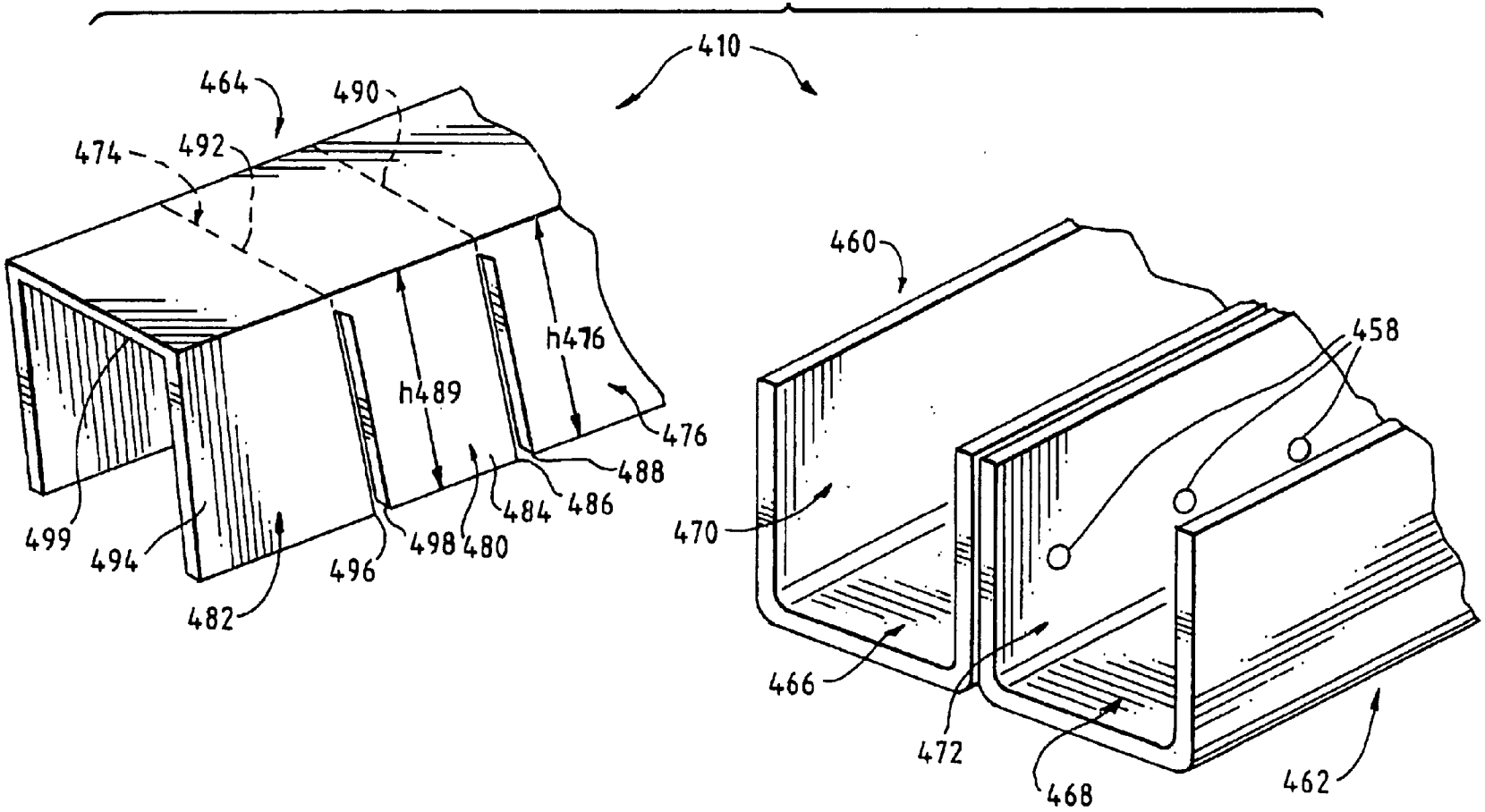
FIG. 7 is a partial perspective view of an alternate embodiment of the packaging container with straight-cut end closures constructed in accordance with the principles of the present invention, the container being shown in separate base and cover units, with the first and second closure panels of the cover unit laid open, prior to folding and securing.

Still another alternate embodiment of the packaging container 410 is illustrated in FIG. 7. The container 410 can include a plurality of base units 460, 462 and a cover unit 464. Both the base units 460, 462 and the cover unit 464 can be formed in a U-shaped cross-section. Preferably, the base units 460, 462 and the cover unit 464 can be made of laminated paperboard material. The base units 460, 462 include generally flat bottom walls 466, 468 and side walls 470, 472. The cover unit 464 includes a generally flat top wall 474 and side walls 476.

The base units 460, 462 and cover unit 464 are sized so that upon assembly into a container the side walls 470, 472 of the base units 460, 462 fit within the side walls 476 of the cover unit 464. As will be recognized by those skilled in the art, the packaging container 410 can be flipped, in which case the side walls of the base will fit within the side walls of the cover.

The packaging container 410 includes a novel end closure 478 configuration. The closure 478 includes first and second straight-cut closure panels 480, 482 formed from an extension of the cover unit 464. The first panel 480 is formed in the cover unit 464 adjacent to the location in the cover unit 464 corresponding to the end of the base units 460, 462. The side walls 484 of the first panel 480 have first straight-cut corners 486. The cover unit side walls 476 also have straight-cut corners 488, immediately adjacent to the first panel straight-cut corners 486. A first fold line or crease 490 can be formed in the cover unit top wall 474 at the juncture of the straight-cut corners 486, 488 to facilitate folding.

The cover unit 464 second closure panel 482 can be adjacent to the first closure panel 480. The second closure panel 482 can be separated from the first panel 480 by a second fold or crease line 492 formed in the top wall 474, parallel to the first fold line 490. The side walls 494 of the second closure panel 482 can include straight-cut corners 496 at the juncture with the first closure panel 480. The side walls 484 of the first closure panel 480 can include second straight-cut corners 498 adjacent to the second closure panel 482. The height $h_{476}$ of the cover unit side walls 476 can be about equal to the heights $h_{484}$, $h_{494}$ of the first closure panel side walls 484 and the second closure panel side walls 494.

To assemble this package 410, the base units 460, 462 can be placed on a surface and filled with articles for packaging. The cover unit 464 then can be placed over the articles with the cover unit side walls 476 outside of and abutting the base units side walls 470, 472. The first fold line 490 of the cover unit 464 can be aligned with the ends of the base units 460, 462. The first panel 480 can be folded downwardly, so that the first panel 480 is perpendicular to the generally flat bottom walls 466, 468 of the base units 460, 462. As the first panel 480 is folded, its side walls 484 can be inserted between the cover unit side walls 476. The second panel 482 then can be folded over, perpendicular to the first panel 480, so that the generally flat top wall 499 of the second panel 482 can lie parallel to the top wall 474 of the cover unit 464. As the second panel 482 is folded, its side walls 494 can be inserted between the side walls 484 of the first panel 480, providing an essentially self-contained package 410.

Alternately, the base units 460, 462 can be attached to one another through a variety of means. In a current embodiment, the base units 460, 462 are attached to one another with plastic rivets 458.

Figure 8:
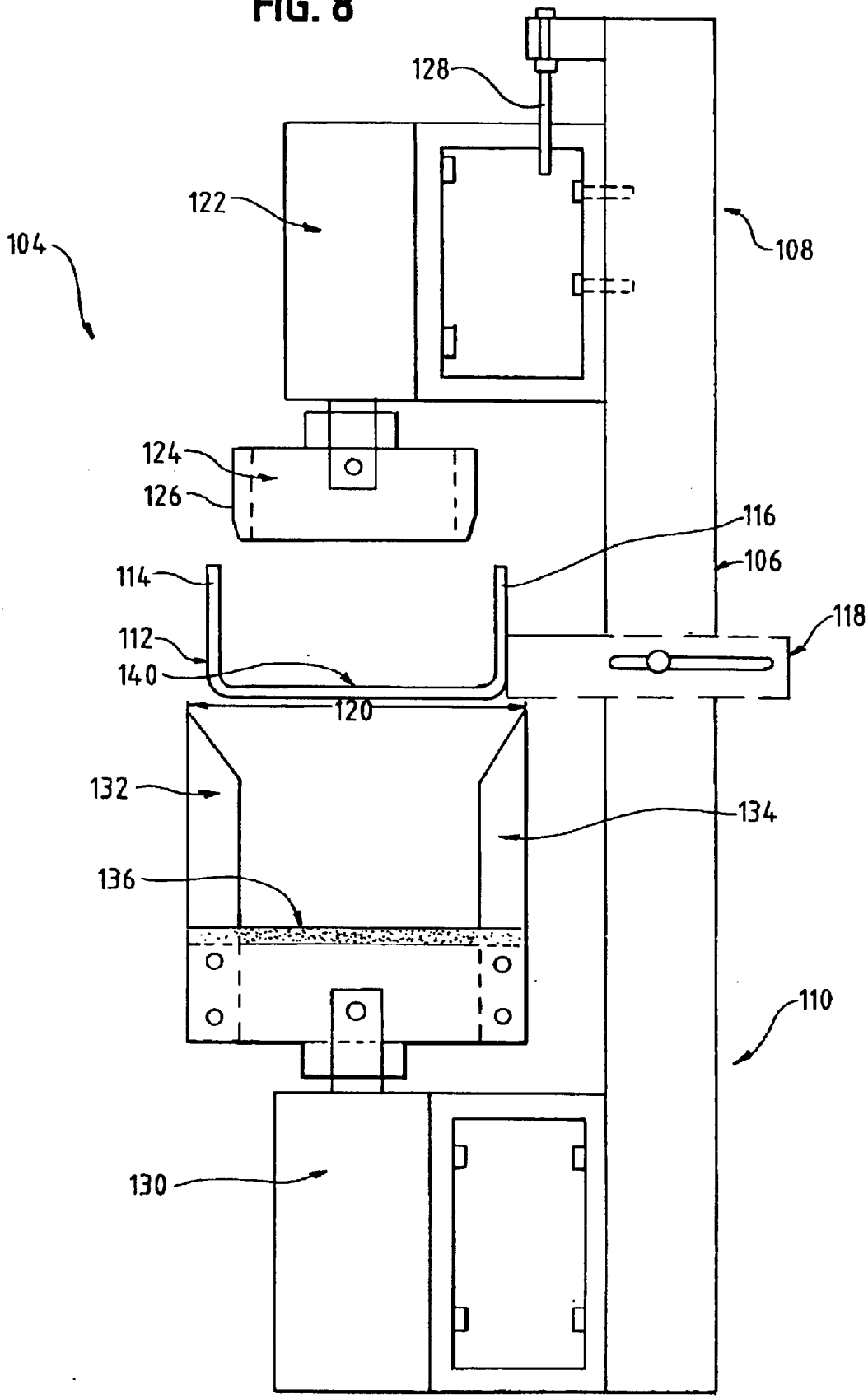
FIG. 8 is a side view of a device for straight-cutting and embossing U-shaped packaging crates, the device being shown in its at-rest position.
Figure 9:
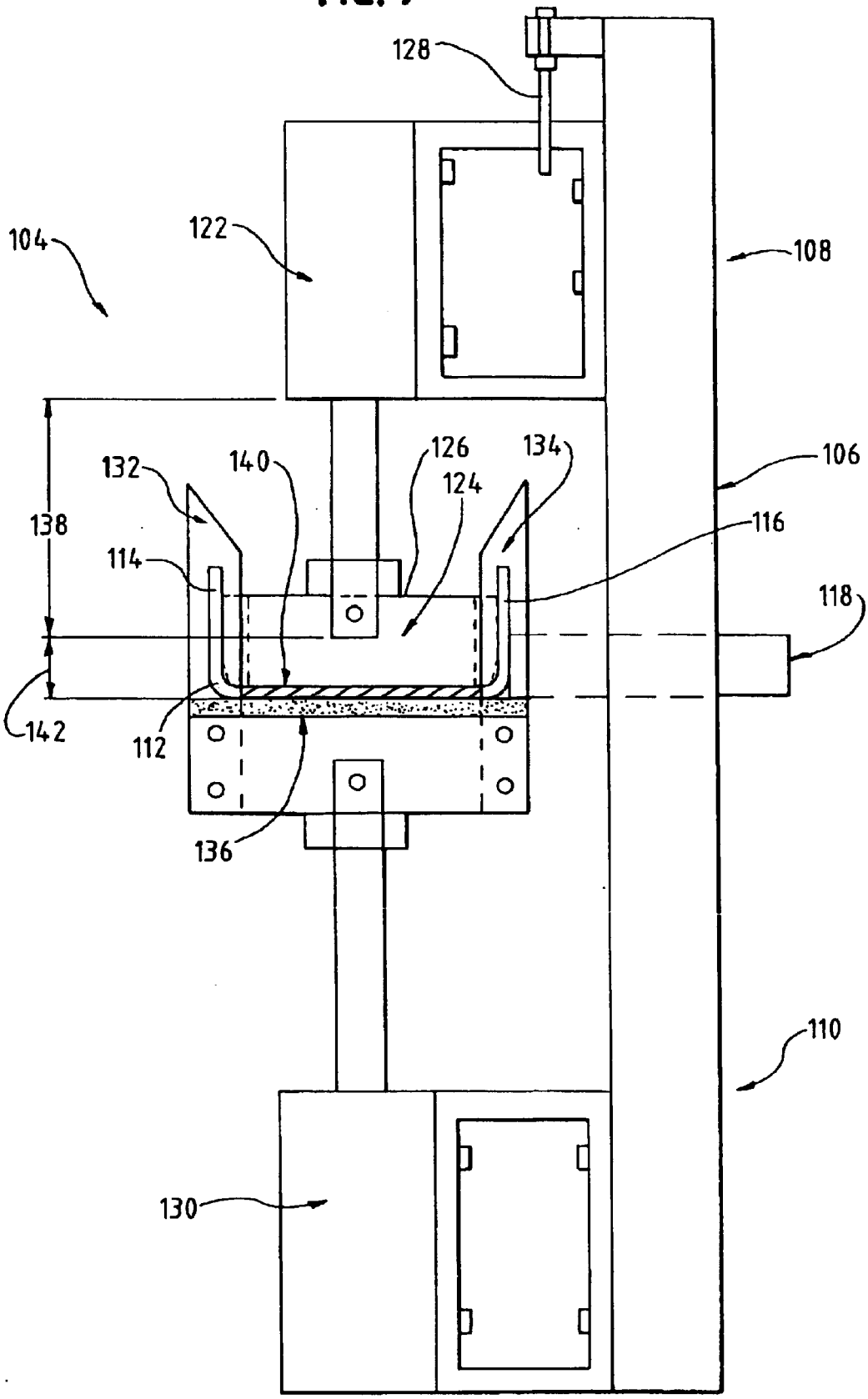
FIG. 9 illustrates the movements of the device of FIG. 8.
Figures 10, 11:
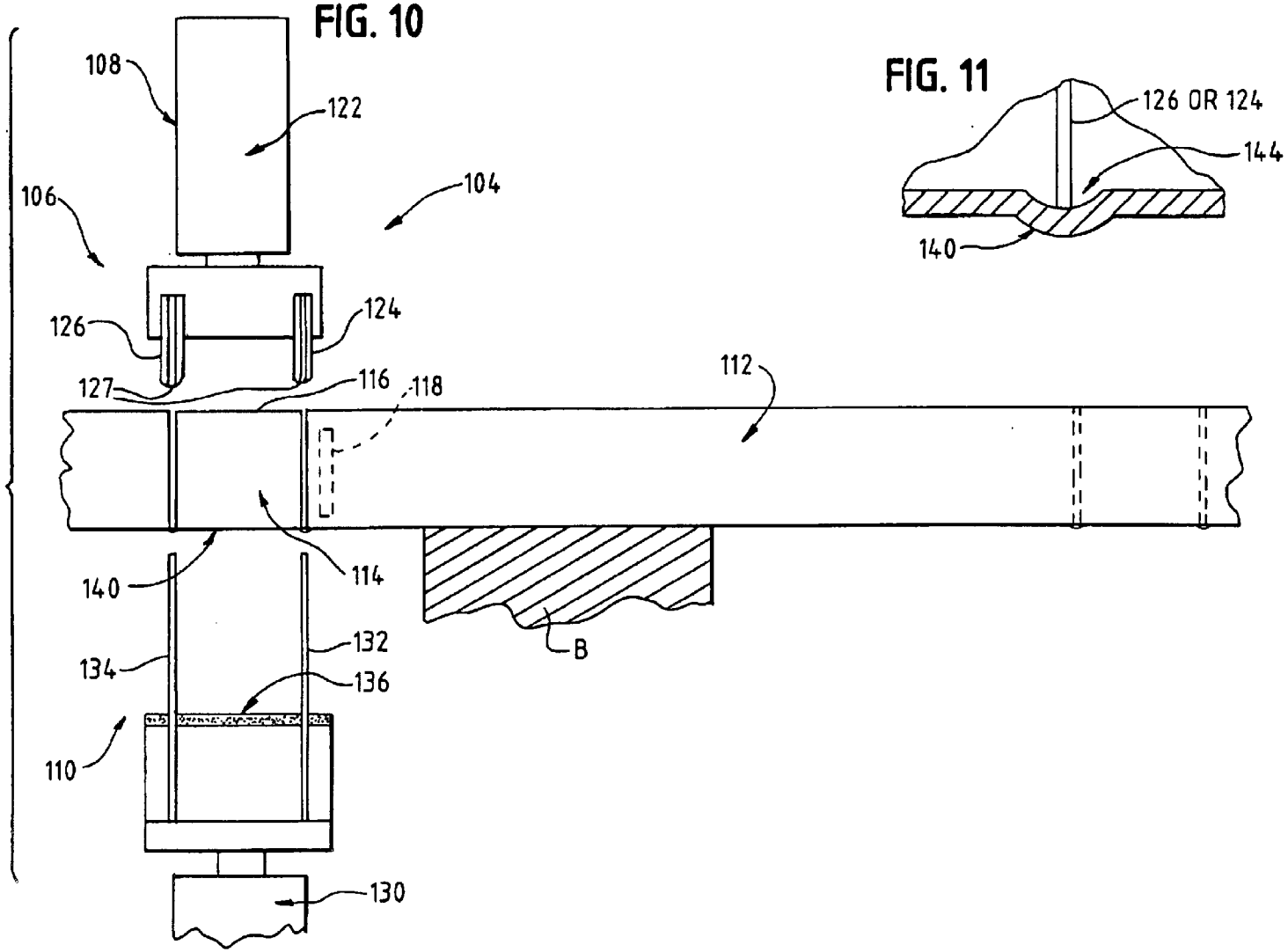
FIG. 10 is an alternate side view of the device of FIG. 8, the device being shown in its at-rest position.
FIG. 11 illustrates an indentation in a packaging crate resulting from use of the device.

Referring now to FIGS. 8–10, there is shown a device 104 for straight-cutting and embossing U-shaped packaging container sections 10, 210, 410. The device 104 includes a frame 106, having an upper embossing/guide assembly 108 and lower cutting assembly 110 mounted thereto. An exemplary U-shaped unit 112 with vertical side walls 114, 116 to be cut is positioned between the upper 108 and lower 110 assemblies. Preferably, the unit is supported by a bench or conveyor mechanism B. The unit 112 is centered and restricted from lateral movement by an adjustable centering arm 118, positioned outside of the cutting plane 120.

The upper assembly 108 includes a two-step air cylinder 122, tooled with dual embossing end-effectors 124, 126. A depth adjustment, such as the exemplary threaded element 128 vertically adjusts the position of the cylinder 122 to accommodate varying unit depths. The lower assembly 110 includes an air cylinder 130, includes two pairs of notching blades 132, 134 and an embossing return pad 136. Preferably, the embossing return pad 136 is made of a resilient material. In a preferred embodiment, the embossing return pad 136 is made of urethane.

Referring now to FIG. 8, at the start of the cutting cycle, both the upper 108 and lower 110 assemblies are clear of the unit 112. As a first step, following manual or automatic activation, the upper air cylinder 122 extends to a first pre-programmed depth 138, causing the end-effectors 124, 126 to come into contact with a generally flat internal bottom wall 140 of the unit 112. The end-effectors 124, 126 provide support for the crate bottom wall 140 and loosely fits between the vertical side walls 114, 116.

Once the device 104 senses that the first step is complete, the lower air cylinder 130 extends, causing the two pairs of notching blades 132, 134 to cut completely through the crate's vertical side walls 114, 116, leaving the crate's bottom wall 140 intact. As seen in FIG. 10, the end-effectors 124, 126 can include guides 127 formed as channels therein. The guides 127 provide a centering means to assure that the blades 132, 134 remain straight during the cutting cycle. As a third step, the two pairs of notching blades 132, 134 remain raised, causing the crate's bottom wall 140 to rest on the embossing return pad 136 (as seen in FIG. 9). Next, the upper air cylinder 122 extends to a second pre-programmed depth 142. The end-effectors 124, 126 therefore embed into the crate internal bottom wall 140, deforming the material into the embossing return pad 136. A resulting indentation 144, as see in FIG. 11, compresses the crate's bottom wall 140 along future bending lines, facilitating the formation of packaging containers. Finally, both the upper 108 and lower 110 segments return to their original positions, as in FIG. 8. As will be appreciated by those skilled in the art, the indentations form a region at which the material will more readily fold to form the container 10, 210, 410.

Advantageously, it has been found that the present device 104 can be used with container units 112 having a wide variety of wall 114, 116 heights with minimal to no adjustment. This increases the flexibility of the packager vis-à-vis selecting a proper package based upon the articles to be packaged, rather than a package for which the device is configured or designed.

In addition, it has been found that cutting rather than sawing the material provides a "cleaner" cut with respect to the ends of the material as well as debris that may be created during the cutting operation. It has further been found that the use of cutting blades 132, 134, moving toward the unattached (e.g., free-) ends of the walls 114, 116 prevent collapses of the walls 114, 116 regardless of the thickness of the material during the cutting operation.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A packaging container, comprising:

a embossed preformed, first unit of U-shaped cross-section having a generally flat base wall and opposing side walls, the first unit being sufficiently rigid such that the side walls maintain their U-shape relative to the base wall without external support and so as to remain upstanding relative to the base wall; and a embossed preformed, second unit of U-shaped cross-section having a generally flat base wall and opposing side walls, the second unit being sufficiently rigid such that the side walls maintain their U-shape relative to the base wall without external support and so as to remain upstanding relative to the base wall, the second unit configured so that the side walls of the first unit are fitted within and embraced by the side walls of the second unit when the first unit and second unit are assembled as a container, the first unit forming an end closure for the packaging container, formed from a first closure panel extending from and adjacent to an end of the first unit, and a second closure panel extending from and adjacent to an end of the first closure panel, the first and second closure panels each having a base wall and opposing side walls, the first unit and the first closure panel being separated from one another by a first fold line in the base wall extending between the side walls, the first closure panel and the second closure panel being separated from one another by a second fold line in the base wall extending between the side walls, the first unit side walls having straight-cut corners at a juncture with the first closure panel side walls and extending substantially to the base wall, and the first closure panel side walls having first straight-cut corners adjacent the first unit side walls and extending substantially to the base wall, the first closure panel side walls having second straight-cut corners adjacent the second closure panel side walls and extending substantially to the base wall and the second closure panel side walls having straight-cut corners adjacent the first closure panel side walls and extending substantially to the base wall, the first closure panel being configured for folding along the first fold line generally perpendicular to the first unit base wall and the second closure panel being configured for folding along the second fold line generally perpendicular to the first closure panel and generally parallel to the first unit base wall.

2. The packaging container in accordance with claim 1 wherein the first unit side walls have a height that is about equal to a height of the first and second closure panel side walls.

3. The packaging container in accordance with claim 2 wherein a third closure panel extends from and is adjacent to an end of the second closure panel, the third closure panel having a base wall and opposing side wall, the second closure panel and the third closure panel being separated from one another by a third fold line in the base wall extending between the side walls, the third closure panel being configured for folding along the third fold line generally parallel to the second closure panel and to the first unit base wall.

4. The packaging container in accordance with claim 1 wherein the first unit includes two end closures, each positioned at an end of the first unit.

5. The packaging container in accordance with claim 1 wherein a divider is placed in the first unit, segregating the first unit into a plurality of compartments.

6. The packaging container in accordance with claim 5 wherein the divider is attached to a side wall of the first unit.

7. A packaging container, comprising:

a plurality of embossed pre-formed, rigid base unit of U-shaped cross-section having generally flat bottom walls and opposing side walls, each of the base units being sufficiently rigid such that the side walls maintain their U-shape relative to the base wall, without external support and so as to remain upstanding relative to their respective base walls; and a embossed preformed, rigid cover unit of U-shaped cross-section having a generally flat top wall and opposing side walls, the cover unit being sufficiently rigid such that the side walls maintain their U-shape relative to the top wall without external support and so as to remain upstanding relative to the top wall, the cover unit configured so that the side walls of the bottom units are fitted within and embraced by the side walls of the cover unit when the base unit and cover unit are assembled as a container, the cover unit forming an end closure for the packaging container, formed from a first closure panel extending from and adjacent to an end of the cover unit, and a second closure panel extending from and adjacent to an end of the first closure panel, the first and second closure panels each having a base wall and opposing side walls, the cover unit and the first closure panel being separated from one another by a first fold line in the base wall extending between the side walls, the first closure panel and the second closure panel being separated from one another by a second fold line in the base wall extending between the side walls, the cover unit side walls having straight-cut corners at a juncture with the first closure panel side walls and the first closure panel side walls having straight-cut corners adjacent the cover unit side walls, the first closure panel side walls having second straight-cut corners adjacent the second closure panel side walls and the second closure panel side walls having straight-cut corners adjacent the first closure panel side walls, the first closure panel being configured for folding generally perpendicular to the cover unit top wall along the first fold line and the second closure panel being configured for folding generally perpendicular to the first closure panel along the second fold line and generally parallel to the cover unit top wall.

8. The packaging container in accordance with claim 7 wherein the cover unit side walls have a height that is about equal to a height of the first and second closure panel side walls.

9. The packaging container in accordance with claim 7 wherein the first and second closure panel side walls are configured for insertion inside the cover unit side walls when the end closure is formed.

10. The packaging container in accordance with claim 7 wherein the cover unit includes two end closures, each positioned at an end of the cover unit.

11. The packaging container in accordance with claim 7 wherein the side walls of the plurality of base units are attached to each other.

* * * * *